United States Patent [19]

Haseltine

[11] Patent Number: 5,048,844

[45] Date of Patent: Sep. 17, 1991

[54] PORTABLE REBOUNDING SOCCER TRAINING GOAL

[75] Inventor: Arthur S. Haseltine, Springfield, Mo.

[73] Assignee: Soccerstop, Inc., Springfield, Mo.

[21] Appl. No.: 634,084

[22] Filed: Dec. 21, 1990

[51] Int. Cl.[5] ..... A63B 63/00

[52] U.S. Cl. ..... 273/400; 273/26 A; 273/29 A; 273/181 F; 273/407; 273/411

[58] Field of Search ..... 273/400, 401, 407, 411, 273/26 A, 29 A, 181 F, 182 R

[56] References Cited

U.S. PATENT DOCUMENTS

| | | | |
|---|---|---|---|
| 3,184,235 | 5/1965 | Hilbrich | 273/26 |
| 3,602,504 | 8/1971 | Chapman et al. | 273/1.5 R |
| 3,698,712 | 10/1972 | Pero | 273/26 A |
| 4,116,446 | 9/1978 | Thomson | 273/181 F |
| 4,203,594 | 5/1980 | Cagle | 273/411 |
| 4,258,923 | 5/1981 | Senoh | 273/398 |
| 4,258,924 | 5/1981 | Ketchum | 273/411 |
| 4,286,786 | 9/1981 | Papadopoulos | 273/411 X |
| 4,407,507 | 10/1983 | Caruso et al. | 273/400 |
| 4,420,158 | 12/1983 | Klock et al. | 273/400 |
| 4,699,386 | 10/1987 | Carzino | 273/411 X |
| 4,842,284 | 6/1989 | Rushing et al. | 273/26 A X |

OTHER PUBLICATIONS

Wiel Coerver Outdoor Training Goal (on sale prior to invention of present device).

Qwik Goal Target Net (on sale prior to invention of present device).

Qwik Rebounder (on sale prior to invention of present device).

*Primary Examiner*—William H. Grieb

*Attorney, Agent, or Firm*—Kokjer, Kircher, Bradley, Wharton, Bowman & Johnson

[57] ABSTRACT

A soccer goal practice device having a frame and a net extending within the frame. The frame has first and second upstanding side members and a cross member extending between, and connected to the top ends of, the side members. The net is formed as a lattice having a perimeter corresponding substantially in shape and size to the frame. The net includes a rugged perimeter cord along the perimeter of the net, and the perimeter cord has a length shorter than that of the perimeter of the net. The perimeter cord is fastened to the frame such that the net extends between the side members and the cross member. Due to the reduced perimeter of the perimeter cord, the net will include a slight blouse when extending over the frame. This blouse causes ground balls entering the net to be rebounded with an upward velocity component, such that rebounded ground balls bounce. This provides a more challenging and realistic return of the ball to the user. The frame is modular such that the entire device may be easily assembled, disassembled and transported.

12 Claims, 1 Drawing Sheet

PORTABLE REBOUNDING SOCCER TRAINING GOAL

BACKGROUND OF THE INVENTION

1. Field of the Invention

The present invention relates in general to sports training equipment. In particular, the present invention relates to an improved soccer training goal with the ability to rebound the ball.

2. Description of the Related Art

Training goals for soccer generally take the form of an actual soccer goal. Such an arrangement takes the form of a generally rectangular framework front opening with a pair of rear extensions angling downwardly from the front top corners of the front framework. A net then covers this framework except for the front opening. While similar in shape, these training goals are typically constructed of lighter weight materials than actual soccer goals to increase their portability. In use, the user kicks the soccer ball towards and into the training goal to practice the various skills necessary during actual soccer play. However, upon entering the goal the ball encounters the net, thus stopping the ball. It is therefore necessary for the user to approach and enter the goal to retrieve the ball before the ball may be used again to practice kicking goals.

To avoid this difficulty, it has been known to draw a representation of the goal opening upon a wall. The user then kicks the ball within the represented goal opening. Upon striking the wall, the ball rebounds such that the user may easily kick the ball again without needless running to retrieve the ball. However, ground conditions accurately simulating a soccer field are usually not found adjacent walls, the opaque nature of the wall does not accurately simulate an actual soccer goal, and wall structures of sufficient size and rigidity are not easily portable.

SUMMARY OF THE INVENTION

It is an object of the present invention to provide a soccer training goal or device which is easily portable to a training site.

Another object of the present invention is to provide a soccer training goal which is easily assembled with minimal tools.

Yet another object of the present invention is to provide a soccer training goal which provides an accurate representation of an actual soccer goal.

It is a further object of the present invention to provide a soccer training goal which will rebound the ball to the user.

It is yet a further object of the present invention to provide a soccer training goal which may be used simultaneously with a user on each side thereof.

These and other objects are achieved by the soccer training goal of the present invention. This training goal includes a framework having upstanding side members and a horizontal cross member extending between, and connected to, the tops of the side members. This framework is composed of a plurality of members which may be easily assembled, disassembled, and transported.

A net extends across the rectangular opening created by the framework. The upper and side edges of the net are connected to the framework in an easily removable manner. When assembled upon the framework, the net will cause the ball to rebound back toward the kicker. The net and/or framework will deform somewhat when the ball forcefully engages the net. In returning to the normal position, the net and/or framework will thus propel the ball outwardly from the training goal to provide a rebounding effect. In addition, the net includes blouse or slack, such that a ball traveling upon the ground and encountering the net will be rebounded slightly upward, causing the rebounded ball to bounce slightly and thus providing the user with a more difficult and realistic ball movement to attempt to again kick into the training goal.

BRIEF DESCRIPTION OF THE DRAWINGS

The objects and features of the invention noted above are explained in more detail with reference to the drawings in which like reference numerals denote like elements and in which.

DETAILED DESCRIPTION OF THE INVENTION

Figure 1:
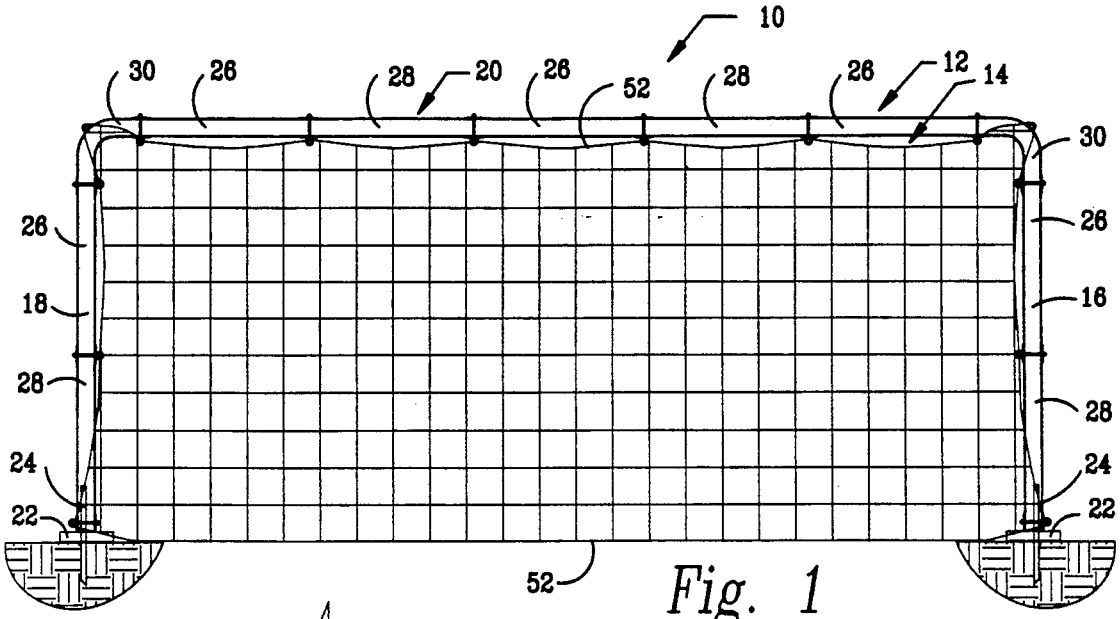
FIG. 1 is an elevation view of the assembled soccer training goal of the present invention.

With reference to FIG. 1, reference numeral 10 generally designates the training goal or device of the present invention. Goal 10 includes a frame 12 and a net 14 attached to the frame 12.

The frame 12 generally takes the form of an inverted U. The frame includes first and second side members 16, 18 respectively, and a cross member 20 extending between the side members and connected to the top ends thereof. In use, the frame 12 is supported by the lower ends of the side members with the cross member 20 elevated above the ground. The frame 12 must, of course, be substantially rigid to support its own weight, the weight of net 14, and any additional forces caused by impact of a ball with the net or frame 12. For this reason, the frame 12 is preferably formed of tubular steel, although other cross-sectional configurations and materials may be suitable.

The lower end of each of the side members 16, 18 includes a support pad 22. The support pads 22 preferably take the form of elongated metal flanges to distribute the weight of the frame and net evenly upon the ground. The support pads 22 extend outwardly from the plane defined by the frame 12 to prevent the goal 10 from tipping over when a ball impacts upon the net 14 or frame 12. It is preferred that the support pads 22 not extend inwardly towards the interior of frame 12 any appreciable distance to minimize interference with the movement of the ball into the frame 12. As may be seen in FIG. 2, the support pads 22 angle downwardly towards the free ends such that the support pads are slightly concave downwardly. This ensures that the free end portions of the support pads 22 engage the ground no matter what the particular contour of the ground, thus insuring against tipping of the goal 10.

Figure 2:
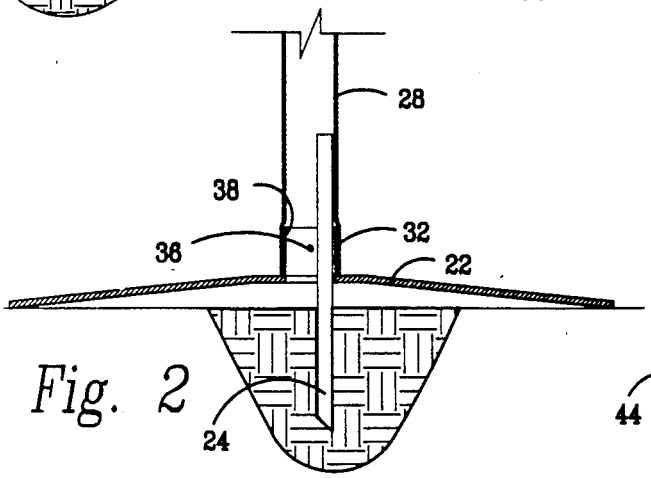
FIG. 2 is a fragmentary view showing the details of the connection of the framework to the ground.

To further secure the training goal 10 against tipping, spikes 24 should be employed. In particular, a spike 24 will be driven into the ground at a location corresponding to each of the side members 16, 18. As best shown in FIG. 2, the tubular side members will then be placed over the respective spike 24, such that each side member receives one of these spikes. It is preferable if the spikes 24 are spaced such that, when inserted into the side members, the spikes abut against the interior of the associated side member at a laterally exterior point. As can be envisioned from FIGS. 1 and 2, the spikes protruding into the side members 16, 18 provide a substantially rigid abutment against the interior of the associated side member to limit the tipping movement of the side members, and thus the entire goal 10.

While is preferable that the frame 12 have a size equal to that of the front entrance of a standard soccer goal, other sizes may of course be employed. In particular, forming the frame 12 smaller than a standard soccer goal entrance may improve the portability of the device as a whole.

In order to further increase the portability of the goal 10, it is preferred that the frame 12 be formed of a plurality of elements which may be assembled for use, or disassembled for storage or transport. In particular, it has been found advantageous to form the frame 12 of a plurality of standardized segments which may be easily assembled to constitute the frame 12.

In the preferred embodiment, the frame 12 is composed of a combination of straight segments 26, flanged segments 28 and a pair of corner segments 30. Each of these segments is formed of tubular steel, with the straight segments constituting simply a length of such tubular steel. The flanged segments 28 are also formed of such tubular steel, but include an enlarged flange portions 32 at each lateral end of the individual flanged segments 28. Similarly, the corner segments 30 are formed of tubular steel, but include a bend of approximately 90°, and preferably 90½°, and flanged ends 34 offset at substantially a 90° angle due to such bend. Each of these segments also includes a diametrically extending through hole 36 spaced a distance from each end of each respective segment.

Each of the support pads 22 includes a frame extension 38 having an outside diameter substantially corresponding to the tubular straight segments 26. Each of the frame extensions 38 also includes a diametrically extending through hole 36 spaced this same pre-determined distance from the upper end of the respective frame extension 38.

In such an arrangement, the side members 16, 18 will consist of the respective support pads 22 with the associated frame extensions 38 thereof extending upwardly. A flanged segment 28 will extend upwardly from the associated support pad 22 with the flanged portion 32 of the flanged segment 28 being received over the associated frame extension 38, as is best shown in FIG. 2. Each of these flanged segments 28 will therefore present an upwardly flanged portion 32, which in turn receives a longitudinal end of one of the straight segments 26. Similarly, each of these straight segments 26 will therefore present an uppermost end, over which a flanged end 34 of a corner segment 30 is received.

Due to the approximately 90° bend of each of the corner segments 30, the corner segments present a substantially horizontally oriented flanged end 34. These flanged end 34 are oriented in opposed relation to begin the cross member 20.

A straight segment 26 is received within each of the flanged ends 34, and present laterally inward ends which are in opposed relation similar to that of the flanged ends 34. Similarly, a flanged segment 28 is received on the laterally inward end of each of the straight segments 26, which results in flanged portions 32 of these flanged segments 28 being in opposed relation. Finally, a single straight segment 26 has a respective end located in each of the flanged portions 32 of these flanged segments 28. This completes the construction of the cross member 20, and as such the frame 12.

The male and female coupling defined by the ends of the straight segments 26 received within the flanged portions 32 or flanged ends 34 is maintained by a fixing means 40. This fixing means 40 could, of course, take many forms. Screw connections or quick disconnect couplings are possible, but it is preferred that the fixing means 40 be comprised of hook bolts 42 and nuts 44.

Figure 4:
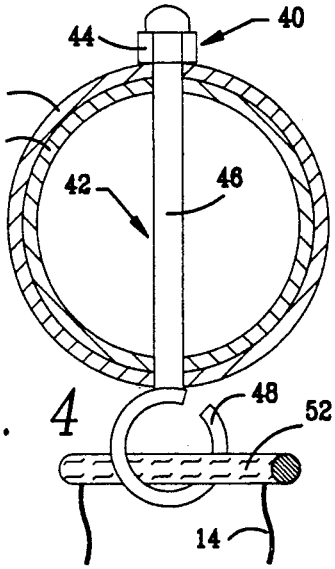
FIG. 4 is a cross-sectional detail view showing the attachment of the net to the framework.

As is best shown in FIG. 4, the male and female connection between each of the respective segments will result in the respective through holes 36 having respective longitudinal locations which are substantially coincident. When the through holes 36 have been angularly aligned, a bolt portion 46 of the hook bolt 42 may be inserted through the pair of through holes 36 at each of the male and female connections between the respective segments. The bolt portion 46 is inserted until a hook portion 48 of hook bolt 42 abuts against the flanged portion 32 or flanged end 34, as the case may be. The nut 44 is then threaded upon the bolt portion 46 extending outwardly from the male and female connection between the segments, fixing the bolt 42 in position, and therefore fixing the male and female connection between the segments.

Figure 3:
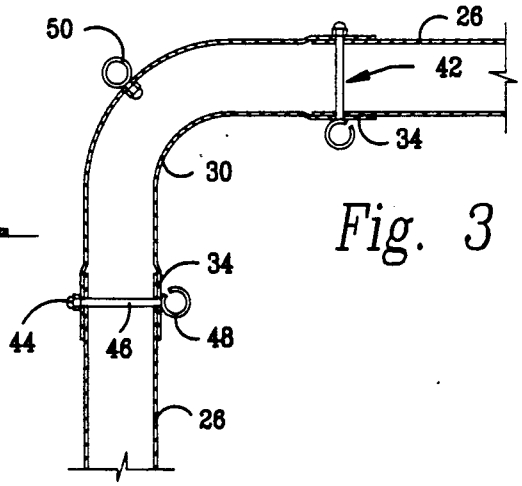
FIG. 3 is a cross-sectional detail view of a corner of the framework of the present invention.

With the hook bolts 42 in position, the frame 12 takes on a substantially rigid and a self-supporting character which will easily take the abuse from impacting soccer balls. In addition, each of the hook bolts 42 includes the hook portion 48 which may be used for attachment of the net 14, as described below. In this regard, it is noted that the corner segments 30 each include a corner hook 50 at the exterior midpoint thereof, as is best shown in FIG. 3. The corner hook 50 may be bolted to the corner segments 30, or may be affixed thereto by other well known means, such as welding. In addition, corner hook 50 need not take the form of an actual hook, but could be a complete circle of material, or merely a cantilevered element.

The net 14 of the present invention may comprise a typical cloth net employed for standard soccer goals or other net applications. It is preferred, however, that the net be formed of a knotless woven structure for increased durability. The fibers forming the net may of course be natural, synthetic or a blend thereof. It is also advantageous to provide an ultraviolet coating upon the net to increase the life thereof.

The net 14 also includes a rugged perimeter cord 52 surrounding the entire perimeter of the net 14. The perimeter cord 52 may be formed of the same or different materials than the knotless net 14, but in either case it is preferred that the perimeter cord 52 and net 14 be formed of non-elastic materials.

As shown in FIGS. 1 and 4, the net 14 is attached to the frame 12 by capturing the perimeter cord 52 within the hook portion 48 of the hook bolts 42. In addition, the perimeter cord 52 is looped over each of the corner hooks 50 on the corner segments 30 and over hook bolts 42 received in holes 36 connecting the flanged segments 28 of the side members 16, 18 to the frame extensions 38 of support pads 22. As shown in FIG. 1, the hook portions 48 of the hook bolts 42 are typically located to extend into the interior portion of the frame 12. Some or all of the hook bolts 42 could be oriented such that the hook portion 48 is on the exterior of the frame 12 to increase the tautness of the net 14. This is particularly advantageous with the hook bolts 42 connecting the support pads 22, for a reason discussed below.

While the above description of the attachment of the net 14 to the frame 12 is made with reference to the hook portions 48 of hook bolts 42, and is of course apparent that other arrangements will be necessary where the various segments comprising the frame 12 are attached by different means. For example, hooks, loops, or cantilevered elements similar to corner hook 50 could be fixed to, or capable of being rigidly fixed to, the various segments of the frame 12.

As can be seen in FIG. 1, when the net 14 has had the perimeter cord 52 thereof retained within the various hook portions 48 and corner hooks 50, the net 14 will extend across the interior of the frame 12 in a backstop configuration.

With regard to the net 14, it is believed to be advantageous to the present invention to form the perimeter cord 52 with a perimeter smaller than that of the net 14. Specifically, the net material of the net 14 will necessarily define a perimeter. The perimeter cord 52, however, is formed with a length smaller than this perimeter of the net material. As such, the net will include a small amount of blouse or slack, even when attached to the frame 12. The perimeter cord 52 will, however, be tautly received upon the frame 12, and present a substantially taut lower edge adjacent the ground. The placement of the spikes 24 are important to this tautness, as they may prevent the lower ends of the side members from moving together to allow slack in the perimeter cord.

It is this taut lower edge and blouse or slack within the net 14 which is believed to provide one of the more advantageous features of the invention. Specifically, when a soccer ball is kicked toward the goal 10 and enters the net 14 on the ground, the ball will engage the net 14. The ball will continue traveling until any slight elasticity within the material of the net 14 is exhausted. However, due to the slight blouse of the net 14 this distance until elasticity has been exhausted will be greater in the center of the net than near the edges thereof. This is simply due to the inherent slack within the net caused by the reduced perimeter cord 52.

A ball engaging the net, however, will attempt to travel in the forward direction (the direction of movement) as far as possible. This will tend to cause the ball to roll upward towards the central area of the net, where the blouse in the net allows the ball to travel a further distance forward. Upon reaching the limit of the elasticity of the net, the ball rebounds. However, since the ball has traveled slightly towards the center of the net, the ball will rebound from a position different than that from which it initially engaged the net. As a result, ground balls which are hit into the goal 10 will rebound from a position slightly spaced from the ground and with a slight upward velocity imposed thereon.

As a result, ground balls hit into the goal 10 will bounce upon rebound from the goal, resulting in a more interesting and challenging ball movement being presented to the user for the next kick.

The inherent nature of the frame 12 may also contribute to the rebound of any ball hit into the net 14. While it is believed that the majority of the rebound of the ball is due to the restitutionary effects of the ball itself upon full impact with the net 14 (after the net 14 has exhausted all elastic behavior), the frame 12 has also been known to bend slightly during such impacts of the ball with the net 14. As such, the frame 12 may provide a slight "slingshot" or bow and arrow effect upon the net to increase the rebound of the ball from the goal 10.

It is also noted that, due to the present construction of the frame 12 and attachment thereto of the net 14, there is no single "correct" side for use of the goal 10. As such, either side of the goal 10 may be used and will provide equal rebound capabilities. As either side of the goal 10 may be employed, it has been found that both sides may also be employed at the same time. Specifically, users may alternate hitting balls into the goal 10 from opposite sides thereof. Even when the balls hit the net 14 at the same time, the only effect upon the rebound of the ball which has been found is a change in the direction of rebound of the ball. No appreciable reduction in the amount of rebound has been seen when two balls strike the goal 10 from opposite directions at the same time.

Figure 5:
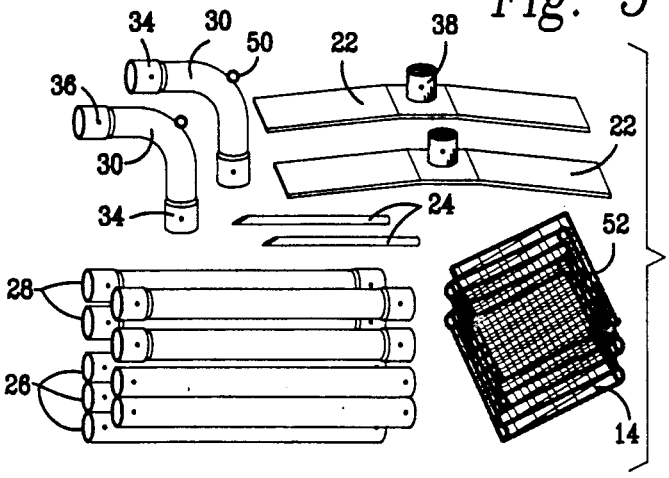
FIG. 5 is a schematic view showing the training goal of the present invention in the dissembled condition.

As may be seen from the above description, the present invention provides a practice goal for soccer which is both highly useful and very practical. In particular, the modular nature of the frame 12 allows the entire goal 10 be broken down into small, easily transportable segments. FIG. 5 shows the unassembled elements of the goal 10. As described above, these unassembled elements would include five straight segments 26, four flanged segments 28, a pair of corner segments 30 and a pair of support pads 22. The net 14 with hook bolts 42 and the pair of spikes 24 complete the elements necessary to construct the goal 10.

As may be seen from FIG. 5, even the largest of the components of the goal 10 is small enough to be transported with a minimum of inconvenience. In this regard, it has been found that a length of 40 inches for each of the straight segments, these being the largest members, will provide an assembled goal of approximately $7\frac{2}{3}$ feet in height and 18 feet in width, while still allowing all of the components of the goal 10 to be received within the trunk of a compact with room left over for other assorted training equipment. With such a completed goal size, it is preferred that the net 14 be formed from a lattice having squares which are 5 inches high and wide. A preferred net size is 43 squares wide by 19 squares high. As such, the perimeter of the net 14 will be 620 inches. For such a net size, it is preferred that the perimeter cord 52 have a length of 618 inches.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A soccer practice device, comprising:

frame means having first and second spaced side members, each of said side members having a top end and a bottom end, and further having a cross member extending between said side members and connected to said side members at said top ends, whereby said cross member is spaced above the ground when said frame means is in an operative position; and net means including a net in the form of a lattice, said lattice having a perimeter corresponding substantially in shape and size to said frame means, and further including a perimeter cord connected to, and extending along, said perimeter of said net, said perimeter cord having a length less than that of said perimeter of said net, and said perimeter cord being connected to said frame at least at spaced locations along said frame, whereby said net means extends between said side members and said cross member.

2. A practice device as in claim 1, further comprising a support pad mounted at said bottom end of each of said side members, said support pads being adapted to maintain said frame means in said operative position.

3. A practice device as in claim 2, wherein each of said members of said frame means comprises a plurality of segments, and further comprising means for releasably connecting said segments to form said frame means.

4. A practice device as in claim 3, wherein said support pads each include an opening extending upwardly therethrough, and further comprising a spike associated with each of said support pads, each said spike being adapted to be partially driven into the ground and extend upwardly into said opening of said associated support pad to thereby assist in maintaining said frame means in said operative position.

5. A practice device as in claim 4, wherein said net is a knotless net.

6. A practice device as in claim 5, wherein said net is treated to reduce damage from ultraviolet light.

7. A practice device as in claim 3, wherein each of said segments have a hollow substantially circular cross section, an outside diameter, and wherein certain of said sections include flanged ends which have an inside diameter substantially equal to said outside diameter, whereby said segments may be assembled end-to-end with said flanged ends forming a male and female connection.

8. A practice device as in claim 7, wherein each of said segments includes a through hole spaced from each end, said through hole extending substantially perpendicular to the longitudinal axis of each said segment, and wherein said means for releasably connecting said segments includes bolts extending through said through holes of said segments, each of said bolts extending through said through holes of two of said segments due to said male and female connections.

9. A practice device as in claim 8, wherein said bolts include means for retaining said perimeter cord, and wherein said perimeter cord is retained within said retaining means.

10. A practice device as in claim 9, wherein each of said support pads includes a frame extension surrounding and extending upwardly from said opening in said support pad, said frame extension being substantially tubular with an outside diameter substantially equal to said outside diameter of said segments such that said frame extensions may form said male and female connection, and having a through hole extending therethrough substantially perpendicular to the longitudinal axis of each said frame extension, and further comprising a bolt extending through each of said through holes of said frame extensions, each of said bolts additionally extending through said through hole of an associated one of said segments due to said male and female connections.

11. A soccer practice device, comprising:

frame means having first and second spaced side members, each of said side members having a top end and a bottom end, and further having a cross member extending between said side members and connected to said side members at said top ends, whereby said cross member is spaced above the ground when said frame means is in an operative position, each of said members of said frame means comprising a plurality of segments;

means for releasably connecting said segments to form said frame means;

net means including a net in the form of a lattice, said lattice having a perimeter corresponding substantially in shape and size to said frame means, and further including a perimeter cord connected to, and extending along, said perimeter of said net, and wherein said means for connecting further includes means for retaining said perimeter cord, said perimeter cord being retained by said retaining means and thereby connected to said frame with said net means extending between said side members and said cross member.

12. A practice device as in claim 11, wherein said perimeter cord has a length less than that of said perimeter of said net.

* * * * *